US005695276A

United States Patent [19]

Tatsukawa

[11] Patent Number: 5,695,276

[45] Date of Patent: Dec. 9, 1997

[54] AUTOMOBILE HEADLAMP

[75] Inventor: Masashi Tatsukawa, Shizuoka, Japan

[73] Assignee: Koito Manufacturing Co., Ltd., Tokyo, Japan

[21] Appl. No.: 739,514

[22] Filed: Oct. 29, 1996

[30] Foreign Application Priority Data

Nov. 2, 1995 [JP] Japan ..... HEI 7-310025

[51] Int. Cl.[6] ..... F21V 7/00

[52] U.S. Cl. ..... 362/297; 362/215; 362/348

[58] Field of Search ..... 362/61, 215, 297, 362/348

[56] References Cited

U.S. PATENT DOCUMENTS 5,079,677 1/1992 Kumagia ..... 362/61

*Primary Examiner*—Carroll B. Dority

*Attorney, Agent, or Firm*—Sughrue, Mion, Zinn, MacPeak & Seas, PLLC

[57] ABSTRACT

A bulb 14 is arranged in such a manner that the lower end of a filament 16 of the bulb 14 coincides with an optical axis Ax of a reflector 10. Horizontal cut line forming steps 12aH out of a plurality of light distribution steps **12*a* constituting a reflecting surface 12 extend over such upper and lower areas as to interpose phantom lines Lh1, Lh2 on the reflecting surface 12 therebetween. The phantom lines will correspond to the horizontal cut lines. Vertical sections of these horizontal cut line forming steps in both upper and lower areas are set to parabolas, each having a short focus, and to parabolas, each having a long focus, respectively. The horizontal cut lines are formed by taking advantage of the luminous fluxes of reflecting light from both areas. Each parabola having a short focus is connected to the corresponding parabola having a long focus at the apex thereof smoothly. As a result, the horizontal cut line forming steps 12aH** can be reduced into a single step without steps and bends.

10 Claims, 5 Drawing Sheets

AUTOMOBILE HEADLAMP

BACKGROUND OF THE INVENTION

1. Field of the Invention

The present invention relates to an automobile headlamp having a reflector with a reflecting surface in which a plurality of light distribution steps are arranged.

2. Related Art

Many conventional automobile headlamps are constructed to control the light distribution of parallel luminous fluxes obtained by reflecting light beams at a reflecting surface formed of a parabolic surface.

However, many of the conventional headlamps have a large inclination angle of their lens to meet automobile design requirements, and such headlamps therefore suffer a limitation in the light distribution control based only on lens steps. Further, there is a demand in design that a headlamp have improved outward appearance through transparency of lenses.

Lately developed are headlamps in which all or part of the light distribution function performed by the lens is delegated to a reflector. That is, as disclosed in U.S. Pat. No. 5,171,082, a reflector in such headlamps is characterized as having a reflecting surface in which a plurality of light distribution steps are arranged and as obtaining a desired light distribution either without forming lens steps or only by forming partially shallow lens steps by setting light distribution steps to appropriate curved surfaces. A reflector having such a reflecting surface will hereunder be referred to as a "stepped reflector".

Such a stepped reflector requires that the reflector thereof be divided into a number of segments. However, it is desired that the outward appearance of a headlamp be improved by minimizing such division of the reflecting surface.

By the way, in order to obtain clear horizontal and oblique cut lines (the demarcation lines between lightness and darkness), the following design has conventionally been selected. A filament is arranged on the optical axis of the reflector, and downward rays of light are cut with a shade inside the bulb (or a shade outside the bulb) in order to obtain the aforementioned cut lines. The same applies to a stepped reflector. For example, a headlamp disclosed in the aforementioned publication also employs a bulb having a shade inside the bulb.

However, when the cut lines are formed by using a shade, nearly half the total area of the reflector is not used, that is, no rays of light from the bulb are injected onto the area. As a result, headlamp efficiency cannot be improved sufficiently.

Therefore, it is desired that the cut lines be formed by taking advantage of the characteristics of the stepped reflector. On the other hand, from the viewpoint of improving the outward appearance of a headlamp, it is also desired that division of the reflecting surface be minimized even in this case.

SUMMARY OF THE INVENTION

The present invention was made in view of the aforementioned circumstances. Therefore, an object of the invention is to provide an automobile headlamp having a stepped reflector, which not only allows cut lines to be formed by the filament and the reflector without recourse to shades, but also contributes to improving the outward appearance of the headlamp.

To achieve the above object, the present invention is applied to the following automobile headlamp. Horizontal or oblique cut line forming steps extend over such upper and lower areas as to interpose phantom lines on a reflecting surface therebetween. The phantom lines will correspond to the cut lines. The shapes of sections orthogonal to the phantom lines are set to predetermined parabolas in the upper and lower areas, respectively.

That is, with respect to horizontal cut line forming, the invention is applied to an automobile headlamp designed to form horizontal cut lines of light distribution patterns for an auxiliary headlamp by a reflector, the automobile headlamp comprising: a reflector comprising a reflecting surface, said reflector comprising a first segment constituted by a plurality of first light distribution .steps and a second segment constituted by a plurality of second light distribution steps, said first and second light distribution steps are arranged on said reflecting surface; a bulb having a filament whose axis extends in a direction of an optical axis of said reflector and being attached to the reflector so that the lower end of the filament coincides with the optical axis, and wherein the light distribution steps of a first segment include horizontal cut line forming steps on flanks of the optical axis, the first segment extends over such upper and lower areas as to interpose a horizontal plane therebetween, the horizontal plane including the optical axis; and in the upper area of the first segment than the horizontal plane, vertical sections of the steps parallel to the optical axis have a long focus on a rear end of the filament on the optical axis and have the same shapes as a parabola having a predetermined peak point located behind the focal point as an apex, and in the lower area than the horizontal plane, the vertical sections of the steps parallel to the optical axis have a short focus on a front end of the filament on the optical axis and have the same shapes as the parabola having the predetermined peak point.

On the other hand, with respect to oblique cut line forming, the invention is applied to an automobile headlamp designed to form horizontal cut lines of light distribution patterns for an auxiliary headlamp by a reflector, the automobile headlamp comprising: a reflector comprising a reflecting surface, said reflector comprising a first segment constituted by a plurality of first light distribution steps and a second segment constituted by a plurality of second light distribution steps, said first and second light distribution steps are arranged on said reflecting surface; a bulb having a filament whose axis extends in a direction of an optical axis of said reflector and being attached to the reflector so that the lower end of the filament coincides with the optical axis, and wherein the second light distribution steps of the second segment being oblique cut line forming steps on flanks of the optical axis, the second segment extending over such upper and lower areas as to interpose an oblique plane therebetween, the oblique plane including the optical axis; and in the upper area of the second segment than the oblique plane, sections of the steps orthogonal to the oblique plane parallel to the optical axis have a first focus on a rear end of the filament on the optical axis and have the same shapes as a second parabola having a predetermined peak point located behind the first focus as an apex, and in the lower area than the oblique plane parallel to the optical axis have a second focus on a front end of the filament on the optical axis and have the same shapes as the second parabola having the predetermined peak point.

By the "filament", it is intended to mean not only filaments in the narrow sense of the word, but also cylindrical light sources.

In the case where a bulb having a filament whose axis extends in the direction of the optical axis of a reflector is attached to the reflector, the lower end of the filament is arranged so as to coincide with the optical axis. As a result of this arrangement, the horizontal cut lines of light distribution patterns for an auxiliary headlamp can be formed by using the reflecting surface areas located on the flanks of the optical axis.

As indicated by the aforementioned construction, the invention is designed to extend the horizontal cut line forming steps located on the flanks of the optical axis out of the plurality of light distribution steps constituting the reflecting surface over such upper and lower areas as to interpose the horizontal plane including the optical axis therebetween.

In addition, the invention is also designed so that in the upper area of the horizontal plane, the horizontal cut line forming steps have the same shapes as parabolas, each parabola having not only the rear end of the filament through the optical axis as a focal point but also a predetermined point located behind the focal point as an apex, and in the lower area, the horizontal cut line forming steps have the same shapes as parabolas, each parabola having not only the front end of the filament through the optical axis as a focal point but also the predetermined point as the apex. Therefore, the following advantages can be obtained.

When the vertical sections in both upper and lower areas are formed into predetermined parabolas having short focuses and predetermined parabolas having long focuses, respectively, the horizontal cut lines can be formed by taking advantage of the luminous fluxes of reflecting light from both areas. Further, since each parabola having a short focus is connected to the corresponding parabola having a long focus smoothly at the apex thereof, the horizontal cut line forming steps can be reduced into a single step without steps and bends. As a result, the outward appearance of the headlamp can be improved with division of the reflector minimized.

Further, as shown by the aforementioned construction, the oblique cut lines of the light distribution pattern for the auxiliary headlamp can also be formed with division of the reflecting surface minimized in a manner similar to the case of forming the horizontal cut lines.

Hence, according to the invention, an automobile headlamp having a stepped reflector can not only form the cut lines without shades, but also improve the outward appearance thereof.

DESCRIPTION OF THE PREFERRED EMBODIMENTS

An embodiment of the invention will now be described with reference to accompanying drawings.

Figure 1:
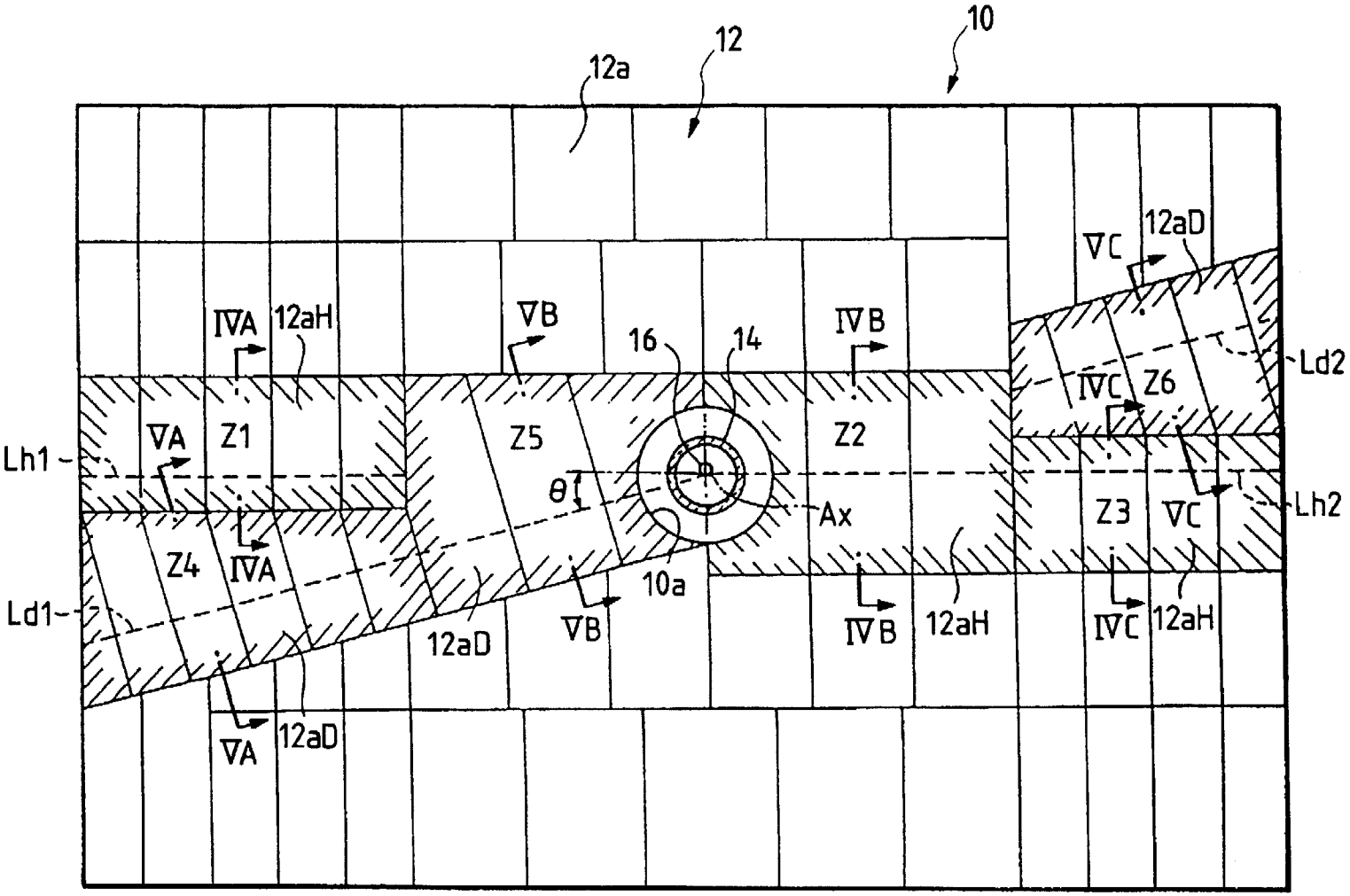
FIG. 1 is a front view showing an automobile headlamp, which is an embodiment of the invention.

FIG. 1 is a front view showing an automobile headlamp, which is one embodiment of the invention.

As shown in FIG. 1, the automobile headlamp, which is the embodiment of the invention, is an auxiliary headlamp in a four-light type headlamp. A reflector 10 of the automobile headlamp is a stepped reflector with a reflecting surface 12 that has a plurality of light distribution steps **12*a* arranged on a predetermined reference parabolic surface. This reflector 10 is designed to generate a desired light distribution pattern as a headlamp without requiring lens-step-based light distribution control. It is for this reason that a plain lens is arranged in front of the reflector 10**.

A bulb insertion hole **10*a* is formed in the apex in the rear of the reflector 10. A bulb 14 is inserted into the bulb insertion hole 10*a*. The bulb 14 has a single filament 16, the axis of the filament 16 extending in the direction of an optical axis Ax of the reflector 10. The bulb 14 is inserted into the hole 10*a* in such a manner that the lower end of the filament 16** coincides with the optical axis Ax.

Figure 2:
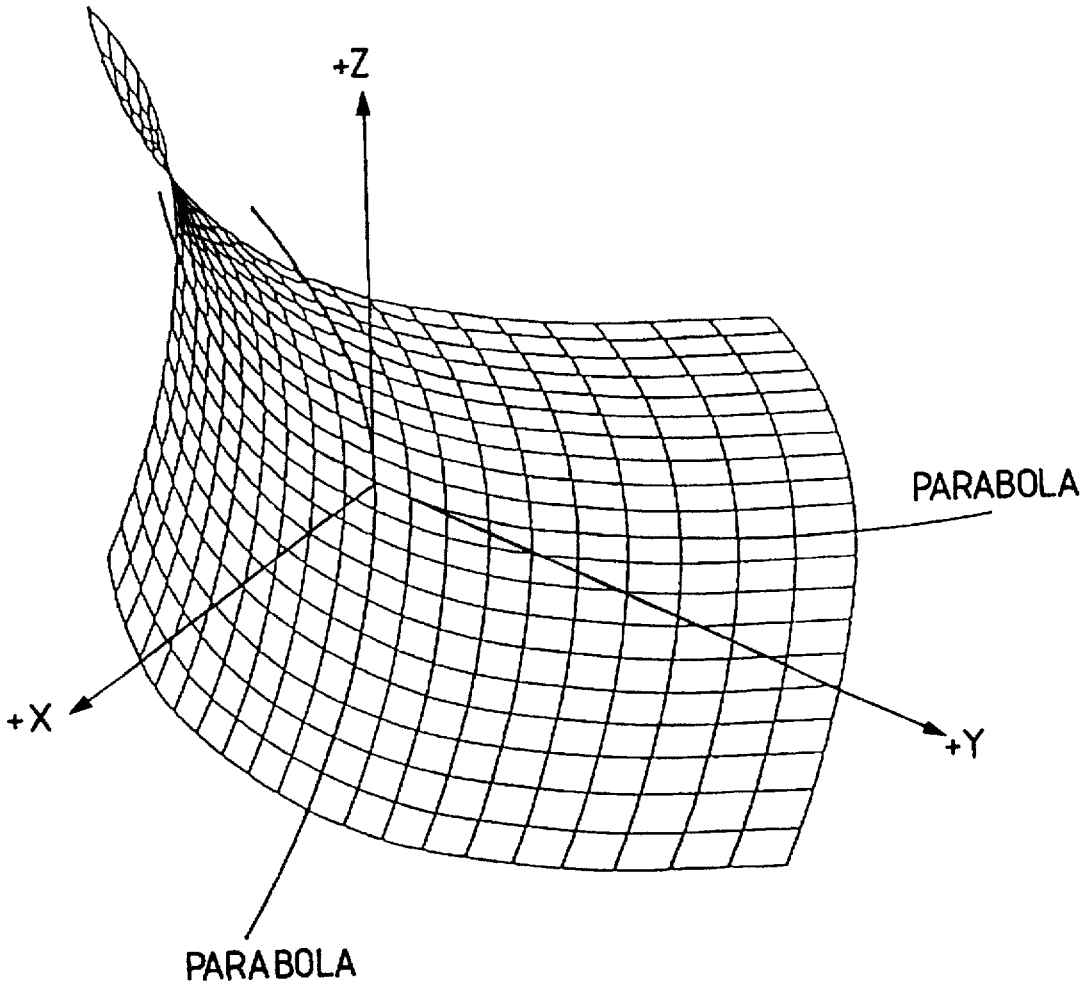
FIG. 2 is a perspective view showing a curved surface formed of light distribution steps, the curved surface constituting a reflecting surface of a reflector in the aforementioned embodiment.

A plurality of light distribution steps **12*a* constituting the reflecting surface 12 are rectangles or obliquely inclined trapezoids. The respective light distribution steps 12*a*** are formed by hyperbolic paraboloids set at respective positions on the reference parabolic surface. Here by "the hyperbolic paraboloid" it is intended to mean a hyperbolic paraboloid that consists of a parabola in which a vertical section (or a section inclined by a predetermined angle θ (θ=15°) from a vertical direction) extends toward the front of the headlamp and in which a horizontal section (or a section inclined by a predetermined angle θ from a horizontal direction) extends toward the rear of the headlamp, or a curved surface analogous to such a parabola as shown in FIG. 2.

Figure 3:
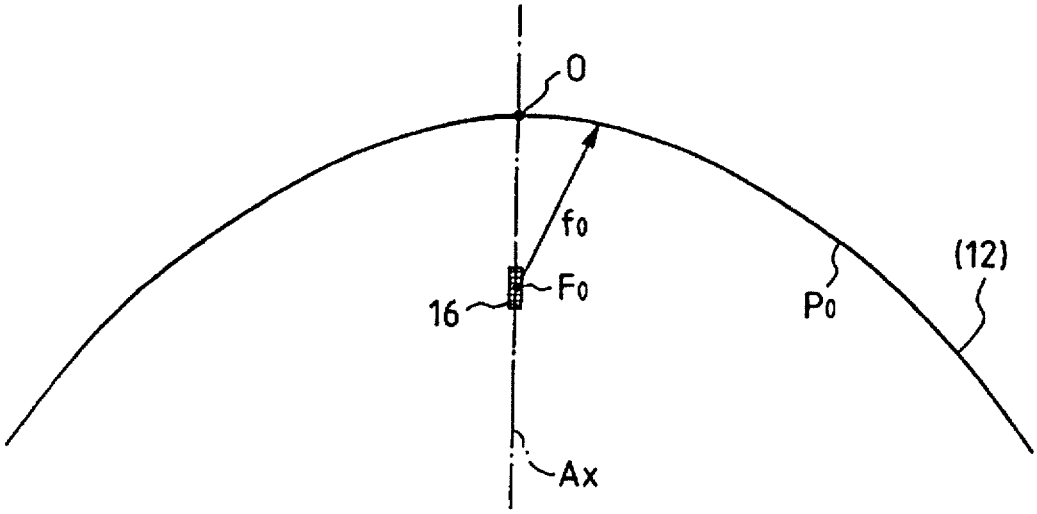
FIG. 3 is a plan view showing a reference parabolic surface of the aforementioned reflecting surface.

In the reflecting surface 12, the reference parabolic surface on which the light distribution steps **12*a* are to be formed is a parabolic surface whose focal distance is fo with a focal point Fo located at the center of the filament 16** as viewed in the longitudinal direction of the filament and with a predetermined point located behind the focal point Fo as the apex O as shown in FIG. 3.

In this embodiment, horizontal and oblique cut lines for the light distribution pattern of the auxiliary headlamp are designed to be formed by the reflecting surface 12 without employing shades or the like. That is, as shown in FIG. 1, light distribution steps 12aH belonging to zones Z1, Z2, Z3 located on flanks of the optical axis Ax form the horizontal cut line forming steps, whereas light distribution steps 12aD belonging to zones Z4, Z5, Z6 located on oblique flanks of the optical axis form the oblique cut line forming steps out of the plurality of light distribution steps **12*a* that form the reflecting surface 12**.

Figure 4A:
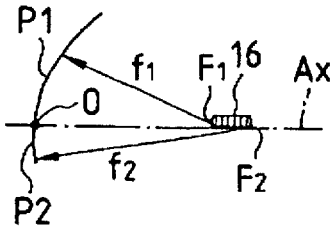
FIG. 4A is a sectional view taken along a line IVA—IVA of FIG. 1.
Figure 4B:
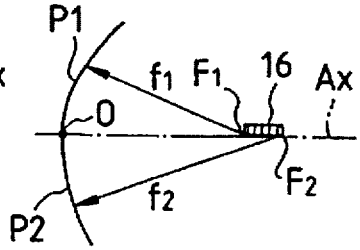
FIG. 4B is a sectional view taken along a line IVB—IVB of FIG. 1.
Figure 4C:
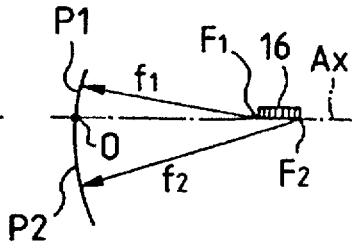
FIG. 4C is a sectional view taken along a line IVC—IVC of FIG. 1.

The respective horizontal cut line forming steps 12aH extend over such upper and lower areas as to interpose phantom lines Lh1, Lh2 (the lines along which a horizontal plane through the optical axis Ax intersects the reflecting surface 12) on the reflecting surface 12 therebetween. The phantom lines will correspond to the horizontal cut lines. The vertical sections of these respective horizontal cut line forming steps 12aH which are parallel to the optical axis Ax are set to such shapes as shown in FIG. 4. FIGS. 4A, 4B, and 4C are sectional views of the horizontal cut line forming steps 12aH belonging to the respective zones Z1, Z2, Z3 taken along lines IVA—IVA, IVB—IVB, and IVC—IVC of FIG. 1.

As shown in FIGS. 4A–4C, the horizontal cut line forming steps 12aH belonging to any zones Z1, Z2, Z3 are set to the following shapes. That is, in the upper area of the phantom lines Lh1, Lh2, these horizontal cut line forming steps 12aH have the same shapes as parabolas P1, each parabola having a focal distance of f1 (f1<fo) with the rear end of the filament 16 on the optical axis Axas a focal point F1 and with a predetermined point O located behind the focal point F1 (the same point as the apex of the reference parabolic surface 12*o*) as the apex. On the other hand, in the lower area of the phantom lines Lh1, Lh2, these horizontal cut line forming steps 12aH have the same shapes as parabolas P2, each parabola having a focal distance of f2 (f2>fo) with the front end of the filament 16 on the optical axis Axas a focal point F2 and with the predetermined point O as the apex.

Figure 5A:
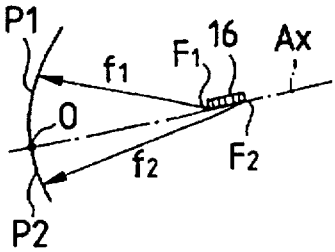
FIG. 5A is a sectional view taken along a line VA—VA of FIG. 1.
Figure 5B:
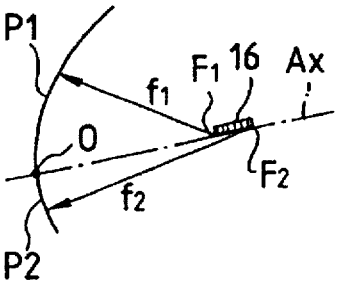
FIG. 5B is a sectional view taker along a line VB—VB of FIG. 1.
Figure 5C:
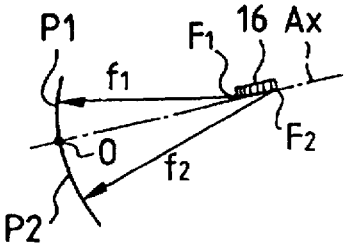
FIG. 5C is a sectional view taken along a line VC—VC of FIG. 1.

On the other hand, as shown in FIG. 1, the respective oblique cut line forming steps 12aD extend over such upper and lower areas as to interpose phantom lines Ld1, Ld2 (the lines along which an oblique plane (a surface rotated only by the angle θ counterclockwise as viewed from the front of the headlamp with respect to the vertical plane) through the optical axis Ax intersects the reflecting surface 12) on the reflecting surface 12 therebetween. The phantom lines Ld1, Ld2 will correspond to the oblique cut lines. The sections orthogonal to the plane inclined by θ of these respective oblique cut line forming steps 12aD which are parallel to the optical axis Ax are set to such shapes as shown in FIGS. 5A–5C. FIGS. 5A, 5B, and 5C are sectional views of the oblique cut line forming steps 12aD belonging to the respective zones Z4, Z5, Z6 taken along lines VA—VA, VB—VB, and VC—VC of FIG. 1.

As shown in FIGS. 5A–5C, the oblique cut line forming steps 12aD belonging to any zones Z4, Z5, Z6 are set to the following shapes in a manner similar to those of the horizontal cut line forming steps 12aH. That is, in the upper area of the phantom lines Ld1, Ld2, these oblique cut line forming steps 12aD have the same shapes as parabolas P1, each parabola having a focal distance of f1 (f1<fo) with-the rear end of the filament 16 on the optical axis Ax as a focal point F1 and with a predetermined point O located behind the focal point F1 as the apex. On the other hand, in the lower area of the phantom lines Ld1, Ld2, these oblique cut line forming steps 12aD have the same shapes as parabolas P2, each parabola having a focal distance of f2 (f2>fo) with the front end of the filament 16 on the optical axis Ax as a focal point F2 and with the predetermined point O as the apex.

If desired, the steps belonging to any zones Z4, Z5 and Z6 may be modified to form another horizontal cut line in a case where the lamp is a foglamp. In this case, as similar to the steps of zones Z1, Z2 and Z3, the light distribution steps extend over such upper and lower areas as to interpose a horizontal plane therebetween. The horizontal plane includes the optical axis, and in the upper area than the horizontal plane, vertical sections of the steps parallel to the optical axis have a first focus on a rear end of the filament on the optical axis and have the same shapes as a second parabola having a predetermined peak point located behind the first focus as an apex. On the other hand, in the lower area than the horizontal plane, the vertical sections of the steps parallel to the optical axis have a second focus on a front end of the filament on the optical axis and have the same shapes as the second parabola having the predetermined peak point.

Figure 6A:
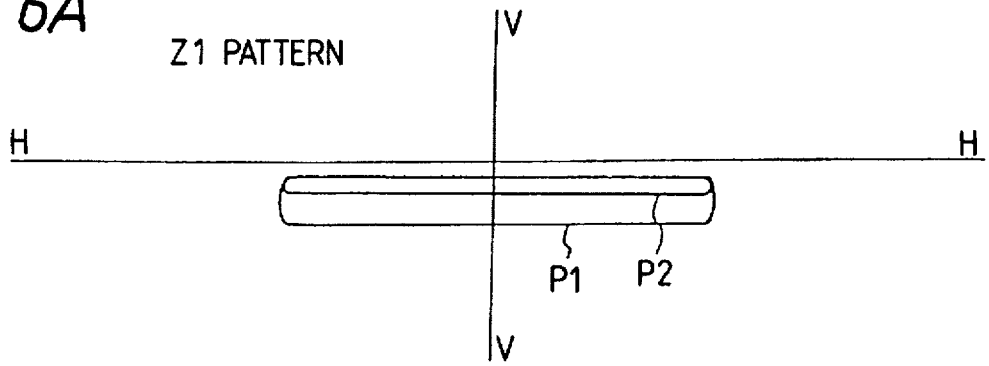
FIGS. 6(A), 6(B) and 6(C) are diagrams showing light distribution patterns formed by horizontal cut line forming steps of the aforementioned embodiment.
Figure 6B:
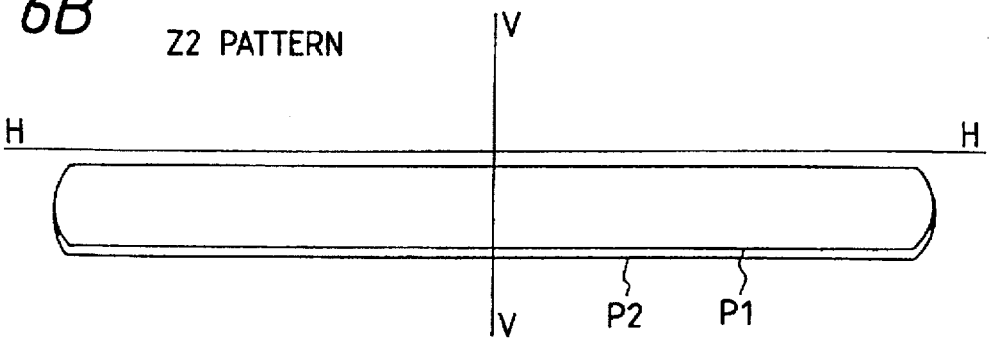
Figure 6C:
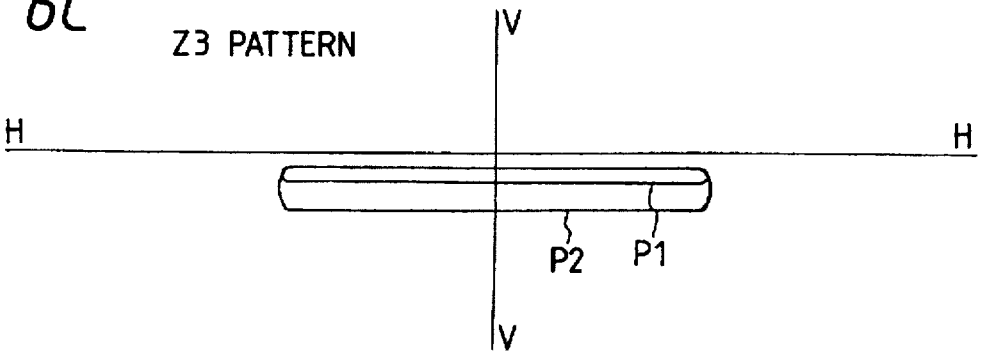
Figure 7A:
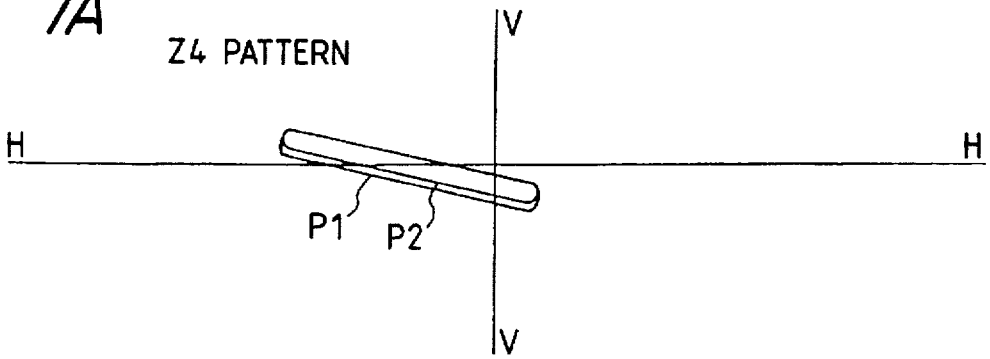
FIGS. 7(A), 7(B) and 7(C) are diagrams showing light distribution patterns formed by oblique cut line forming steps of the aforementioned embodiment.
Figure 7B:
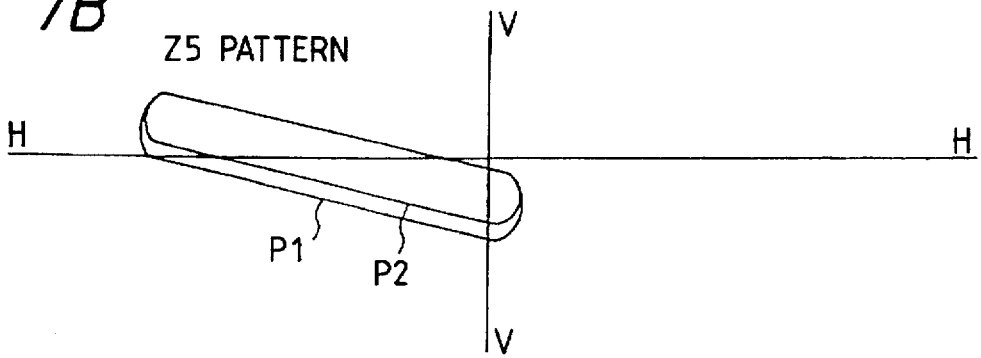
Figure 7C:
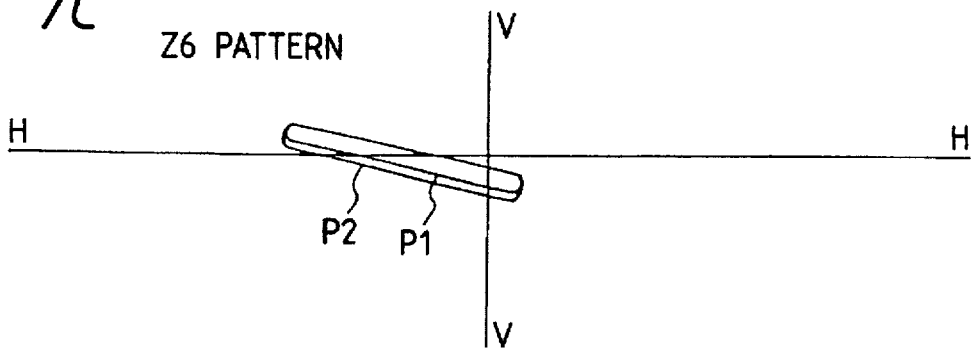

FIGS. 6A–6C is a diagram showing light distribution patterns formed by the horizontal cut line forming steps 12aH. The light distribution patterns formed by the horizontal cut line forming steps 12aH belonging to the respective zones Z1, Z2, Z3 are such as shown in FIGS. 6A, 6B, 6C. Reference characters P1 and P2 in these light distribution patterns denote patterns formed by the luminous fluxes of reflecting light from the respective upper and lower areas with respect to the phantom lines Lh1, Lh2. Further, FIGS. 7A–7C are diagrams showing light distribution patterns formed by the oblique cut line forming steps 12aD. The light distribution patterns formed by the oblique cut line forming steps 12aD belonging to the respective zones Z4, Z5, Z6 are such as shown in FIGS. 7A, 7B, 7C. Reference characters P1 and P2 in these light distribution patterns denote patterns formed by the luminous fluxes of reflecting light from the respective upper and lower areas with respect to the phantom lines Ld1, Ld2.

As described in the foregoing in detail, this embodiment is characterized as arranging the bulb 14 having the filament 16 in such a manner that the lower end of the filament 16 coincides with the optical axis Ax of the reflector 10. Therefore, the horizontal as well as oblique cut lines of the light distribution patterns for the auxiliary headlamp can be formed by using the reflecting surface areas located on the flanks of the optical axis Ax.

The present embodiment is also characterized as not only extending the horizontal cut line forming steps 12aH located on the flanks of the optical axis Ax over such upper and lower areas as to interpose the phantom lines Lh1, Lh2 on the reflecting surface 12 therebetween out of the plurality of light distribution steps 12*a* forming the reflecting surface 12, the phantom lines corresponding to the horizontal cut lines, but also setting the vertical sections in the upper and lower areas of these phantom lines Lh1, Lh2 to the parabolas P1 with short focuses and the parabolas P2 with long focuses. Therefore, the horizontal cut lines can be formed by taking advantage of the luminous fluxes of reflecting-light from these areas. On the other hand, the present embodiment is also characterized as not only extending the oblique cut line forming steps 12aD located on the oblique flanks of the optical axis Ax over such upper and lower areas as to interpose the phantom lines Ld1, Ld2 on the reflecting surface 12 therebetween, the phantom lines corresponding to the oblique cut lines, but also setting-the sections orthogonal to the phantom lines in the upper and lower areas to the parabolas P1 with short focuses and the parabolas P2 with long focuses. Therefore, the oblique cut lines can be formed by taking advantage of the luminous fluxes of reflecting light from these areas.

Further, each parabola P1 with a short focus is connected to the corresponding parabola P2 with a long focus at the apex O smoothly in this embodiment. Therefore, the horizontal cut line forming steps 12aH can be reduced into a single step without steps and bends. As a result, division of the reflecting surface 12 is minimized, thereby contributing to improving the outward appearance of the headlamp.

According to the embodiment of the invention, the automobile headlamp has a stepped reflector, which not only allows the cut lines to be formed without shades but also contributes to improving the outward appearance of the headlamp.

While the case where the light distribution steps 12*a* constituting the reflecting surface 12 are formed on a hyperbolic paraboloid in the aforementioned embodiment, the invention is not, of course, limited to this embodiment. For example, other curved surfaces including an elliptic paraboloid or parabolic surface may be employed. It may be noted that by the "elliptic paraboloid" it is intended to mean an elliptic paraboloid that consists of a parabola in which both a vertical section (or a section inclined by a predetermined angle θ (θ=15°) from a vertical direction) and a horizontal section (or a section inclined by a predetermined angle θ from a horizontal direction) extend toward the front of the headlamp, or a curved surface analogous to such a parabola.

Moreover, while the auxiliary headlamp having the bulb with a single filament has been described in the aforementioned embodiment, the invention may be applied to the function of a headlamp with a bulb of double filaments serving both main and auxiliary headlamps. A bulb having a pair of filaments that are substantially juxtaposed or a like bulb may be taken as a specific example of the bulb having double filaments used in the above case.

What is claimed is:

1. An automobile headlamp designed to form horizontal cut lines of light distribution patterns for an auxiliary headlamp by a reflector, the automobile headlamp comprising:

a reflector comprising a reflecting surface, said reflector comprising a first segment constituted by a plurality of first light distribution steps and a second segment constituted by a plurality of second light distribution steps, said first and second light distribution steps are arranged on said reflecting surface;

a bulb having a filament whose axis extends in a direction of an optical axis of said reflector and being attached to the reflector, and said first light distribution steps of said first segment being horizontal cut line forming steps on flanks of the optical axis, said first segment extending over such upper and lower areas as to interpose a horizontal plane therebetween, said horizontal plane including the optical axis; and in the upper area of said first segment than the horizontal plane, vertical sections of said steps parallel to the optical axis have a first focus on a rear end of the filament on the optical axis and have the same shapes as a first parabola having a predetermined peak point located behind the first focus as an apex, and in the lower area than the horizontal plane, the vertical sections of said steps parallel to the optical axis have a second focus on a front end of the filament on the optical axis and have the same shapes as said first parabola having said predetermined peak point.

2. The automobile headlamp of claim 1, wherein said second light distribution steps of said second segment being oblique cut line forming steps on flanks of the optical axis, said second segment extending over such upper and lower areas as to interpose an oblique plane therebetween, said oblique plane including the optical axis; and in the upper area of said second segment than the oblique plane, sections of said steps orthogonal to the oblique plane parallel to the optical axis have a first focus on a rear end of the filament on the optical axis and have the Same shapes as a second parabola having a predetermined peak point located behind the first focus as an apex, and in the lower area than the oblique plane parallel to the optical axis have a second focus on a front end of the filament on the optical axis and have the same shapes as said second parabola having said predetermined peak point.

3. The automobile headlamp of claim 1, wherein said second light distribution steps of said second segment being horizontal cut line forming steps on flanks of the optical axis, said second segment extending over such upper and lower areas as to interpose a horizontal plane therebetween, said horizontal plane including the optical axis; and in the upper area of said second segment than the horizontal plane, vertical sections of said steps parallel to the optical axis have a first focus on a rear end of the filament on the optical axis and have the same shapes as a second parabola having a predetermined peak point located behind the first focus as an apex, and in the lower area than the horizontal plane, the vertical sections of said steps parallel to the optical axis have a second focus on a front end of the filament on the optical axis and have the same shapes as said second parabola having said predetermined peak point.

4. The automobile headlamp of claim 1, wherein said first and second parabolas are connected to each other smoothly at the apex thereof.

5. The automobile headlamp of claim 1, wherein a lower end of the filament coincides with the optical axis.

6. The automobile headlamp of claim 1, wherein each of said light distribution steps is rectangular.

7. The automobile headlamp of claim 1, wherein each of said light distribution steps is obliquely inclined trapezoids.

8. The automobile headlamp of claim 1, wherein said light distribution steps constituting said reflecting surface are formed of a hyperbolic paraboloid.

9. The automobile headlamp of claim 1, wherein said light distribution steps constituting said reflecting surface are formed of an elliptic paraboloid.

10. The automobile headlamp of claim 1, wherein said light distribution steps constituting said reflecting surface are formed of parabolic surface.

* * * * *